US005961433A

United States Patent [19]

Mitchell et al.

[11] Patent Number: 5,961,433

[45] Date of Patent: Oct. 5, 1999

[54] METHOD AND APPARATUS FOR FORMING BAGS FROM FLEXIBLE PLASTICS SHEET

[75] Inventors: Brian Anthony Mitchell; Graham John Waters, both of Coventry, United Kingdom

[73] Assignee: Le Sac Limited, Coventry, United Kingdom

[21] Appl. No.: 08/897,721

[22] Filed: Jul. 21, 1997

[30] Foreign Application Priority Data

Jul. 20, 1996 [GB] United Kingdom ..... 9615271

[51] Int. Cl.[6] ..... B65B 41/18

[52] U.S. Cl. ..... 493/210; 493/217; 493/193; 493/933; 493/968; 53/449; 53/172

[58] Field of Search ..... 383/105, 119; 493/210, 217, 218, 194, 193, 933, 936, 931, 968; 53/452, 449, 456, 172, 563

[56] References Cited

U.S. PATENT DOCUMENTS 3,537,225 11/1970 Fields .
3,618,478 11/1971 Piazze .
4,636,190 1/1987 Herder ..... 493/936 X
5,328,267 7/1994 Cuddy et al. ..... 383/105
5,556,205 9/1996 Gallie et al. ..... 383/105
5,618,255 4/1997 Nickell et al. ..... 493/217

*Primary Examiner*—Linda Johnson
*Attorney, Agent, or Firm*—Oppenheimer Wolff & Donnelly LLP

[57] ABSTRACT

Bags, primarily for liquid or other flowable products, are formed from sheet plastics material to define a generally rectangular container closed at one end and with a filling and discharging arrangement at the other end. The bags are formed from an outer sheet 10 and an inner sheet 11, the outer sheet extending the full length of the bag whereas the inner sheet extends only part way along the bag. The outer sheet defines pockets 15 which act as the corners of the rectangle and the inner sheet extends across the corners of the rectangle and is connected to the outer sheet adjacent the edges of the pockets. The bag is made by feeding the two sheets of material onto a table, the outer sheet 10 lying below the inner sheet 11. The outer sheet is drawn down to form the pockets 15 at spaced locations along the table. The inner sheet is then welded to the outer sheet at 18, 19 adjacent the edges of the pockets. The ends of the inner and outer sheets are then drawn over, overlapped and connected together to form a tube and one end of the tube is closed after the bag is filled.

14 Claims, 3 Drawing Sheets

METHOD AND APPARATUS FOR FORMING BAGS FROM FLEXIBLE PLASTICS SHEET

This invention relates to a method and apparatus for forming bags from flexible plastics sheet and to bags produced thereby.

It has been proposed to provide bags formed from flexible plastics sheet having an outer part and an inner part, the outer part defining the bag enclosure and the inner part being secured to the outer part to cause the outer part to take up a generally rectangular configuration when filled, the inner part taking up a generally octagonal shape and being secured to the outer part and between the corners thereof.

Hitherto in commercial production the bags have been formed with the outer sheet having corner welds between four lengths of sheet material to form a tube, the inner sheet being located and secured within the outer sheet thus formed. Machines for forming such bags have been relatively complex and expensive. Although the machine can be adapted for different sizes of bag it is not always necessary to have such an adaptable machine.

An object of the invention is to provide a simplified method of and apparatus for forming bags from flexible plastics sheet.

According to one aspect of the invention there is provided a method of forming a bag from flexible plastics sheet material wherein two lengths of flexible plastic are laid one over the other, one of the lengths being to define the outer portion of the bag the other length providing the inner portion of the bag, said outer length being shaped to provide a succession of pocket portions extending transverse to its length, said pocket portions extending out of the plane of said length, said shaping involving moving the outer length in its longitudinal direction to form said portions, securing together the inner and outer lengths between said pocket portions, forming the ends of the two lengths, and bringing the ends together to form a closed formation, securing the ends together to form a tube and securing one end of the tube to form a closed end tube, the other end comprising a filling opening for the bag.

The bag is generally formed with four of said pocket portions equally spaced from one another and, after the ends of the lengths are secured together, there is formed a tube which, when the plastics material is put under tension in the circumferential direction, such as when the bag is filled, the outer length takes up a generally rectangular shape in cross-section with said pocket portions forming the outer corners of the rectangle. The inner length is generally in the shape of an octagon in the tensioned position.

The end of the bag may be formed by securing together the sheets at an end of the tube in the transverse direction. Conveniently the end of the tube may also be connected together by diagonal joins extending between a central position at the end of the bag and a position displaced along the bag from said end. These diagonal joins provide a base in the bag which is shaped to prevent the product from collecting in any corners or folds.

Joining together of the lengths of material is normally by welding by applying direct heat over a specified part of the material, but ultrasonic or high frequency welding may also be employed.

The flexible plastics material may be of the kind having different properties in the plastic layer. Thus one of the plastics materials may have a lower melting point than the other so that when two lengths of material are laid one on the other with the low melting point layers together, the application of heat at the melting temperature of the lower melting point material welds the lengths together, without melting the other layer of plastics. This helps to ensure that the welds are secure without creating weaknesses in the joined lengths adjacent the welds.

Preferably the shaping of the outer length of material to form said succession of pocket portions is achieved by drawing said portions out of said plane by creating a vacuum along said length to draw said portions out of said plane.

Conveniently the lengths of material are laid on a table with the lower length, to form the outer portion of the bag, supported by the table. The table is formed with parts defining openings through which said pocket portions are displaced, conveniently by said vacuum.

The openings may be formed by articulated plates extendable out of the plane of the table and perforated to direct the vacuum onto said portions of plastics material and draw said portions out of the plane of said length a predetermined extent through said openings. Alternatively the mechanical action of the articulated plates draws said portion out of the plane of said length a predetermined extent through said openings.

After forming said pocket portions the inner and outer lengths may be welded together at predetermined positions between said pocket portions using the table surface as an abutment.

After welding together the lengths the united lengths may be severed at one end in a transverse direction to the lengths and the free ends of the lengths are brought together, overlapped and welded together.

The joining of the ends may be performed on said table by bringing a former over the lengths, moving the ends of the lengths over the former until they are together and overlapped, then welding the ends together using the former as an abutment.

The former may have an octagonal shape corresponding to the intended shape of the inner length within the finished bag.

The invention also provides a bag formed of plastic sheet by the method of the invention, the bag having an internal length of plastic sheet and an external length of plastic sheet, the external length of plastics having said pocket portions, and the internal length of plastic sheet being welded to the external length adjacent the edges of the pocket portions, the ends of the joined internal and external lengths being welded together along a weld extending parallel to the pocket portions.

Normally the inner length of material will have a narrower width than the outer length.

One end of the bag may have a transverse weld to join together the external lengths at one end of the bag and close said end of the bag. The opposite end of the bag defines a filling opening which may be closed, after filling, by further welding.

The completed bag may be provided with a product discharge outlet secured internally of the bag and accessible through an opening to be formed in the external length of plastics material.

Apparatus for carrying out the method of the invention comprises a table surface over which two lengths of flexible plastics sheet are laid, one over the other, the table defining means for drawing the lower length of material to define pocket portions extending out of the plane of said length at spaced locations along the table, welding means positioned over the table to secure the lengths of material together between said pocket portions, forming means whereby the ends of the connected lengths are brought together for welding the ends together to form a tube, and securing means for forming a base closure at one end of the bag.

Conveniently the table defines openings through which the lower length of material can be drawn to form said pocket portions, said openings being made after the lengths of material are laid on the table and the lower length of material being drawn down through said openings, preferably by vacuum or mechanical means.

A former may be provided to be located over the table and about which the interconnected lengths of material are arranged so that the ends are brought together to be secured together to provide a closed length or tube of sheet material. The former is conveniently movable to release the closed length and to assist in folding up the length to the desired position for sealing one end of the bag with a transverse overlapping weld.

Further features of the invention will become apparent from the following description of an embodiment of the invention given by way of example only and with reference to the drawings, in which.

Figure 1:
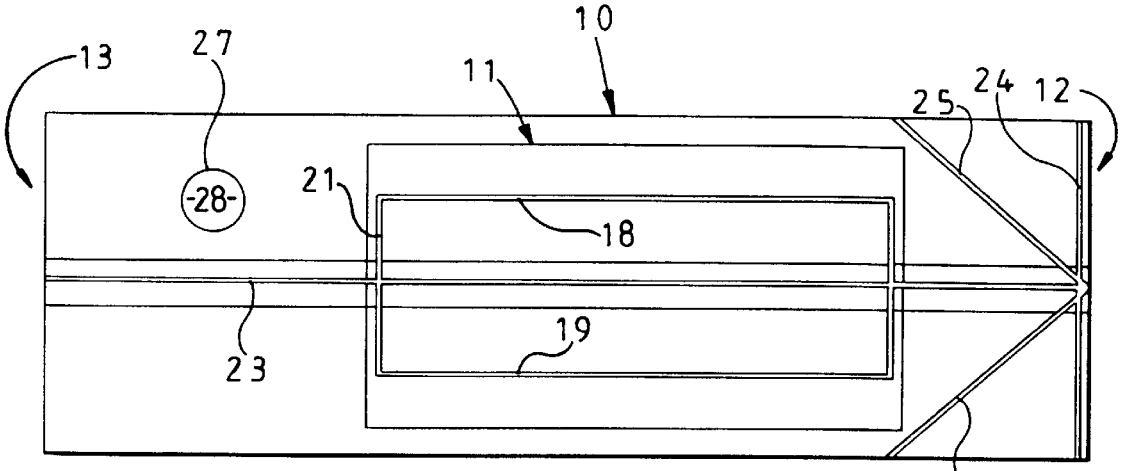
FIG. 1 shows a side elevation of a bag made according to the invention.
Figure 2:
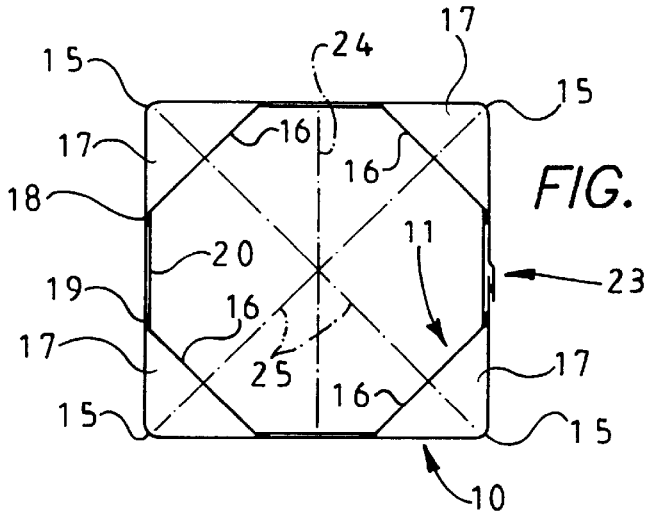
FIG. 2 shows an end view of the bag of FIG. 1.

Referring to the drawings, and firstly to FIGS. 1–4, a bag is shown formed from flexible plastics sheet material. In FIG. 1 the bag is shown in its flat, folded form prior to filling. In FIG. 2 the bag is shown in its completed state and in the shape which it would adopt when filled with material, for example powder or liquid material for which the bag is primarily intended. In its completed state the bag is closed at one end and has an open end through which product may be filled into the bag, the open end being closable after filling.

The bag is formed of two sheets of flexible plastics material, one sheet being designated the outer sheet 10 and the other sheet, designated the inner sheet 11. The outer sheet 10 extends the full length of the bag whereas the inner sheet 11 extends from a position spaced from a closed end 12 of the bag to a position spaced from an initially open end 13 of the bag.

In each case the plastics material from which the outer and inner sheets 10 and 11 are formed is flexible plastics material which can be welded by suitable welding apparatus such as thermal welding, ultrasonic welding or high frequency welding, in known manner. However a flexible plastics sheet material, known as coaxial plastics, may be used with advantageous results, as will be described.

In the tensioned and filled condition (FIG. 2) the bag takes up a shape which is generally rectangular or square in cross section, the outer part 10 being formed with corners 15, and the inner part 11 being of generally octagonal shape in cross section so that portions 16 extend across the corners and form open channels 17 extending between the upper and lower ends of the inner portion 11. Thus the space 17 is accessible by product within the bag from the ends of the channels to fill the channels. The inner portion 11 extends around the interior of the outer portion 10 and is secured to the outer portion by longitudinal welds 18 and 19 extending longitudinally of each of the sides of the outer portion 10 so that portions 20 of the inner part 11 lie flush with the sides of the outer portion 10. There are also transverse welds 21 at the upper and lower ends of the inner portions 20.

Since the bag is generally rectangular there are four corner portions 15 spaced about the bag and the portions 15 are able to take up the position shown in FIGS. 1 and 2 by reason of the portions 16 of the inner part 11. This construction provides for a bag which, when filled, is of elongate square section as shown, or rectangular section and can, if necessary, be placed in a correspondingly shaped container, such as a cardboard or other box (not shown).

The outer and inner sheets 10 and 11 are joined at welds 18, 19 and 21 during manufacture (as will be described) in a generally laid flat position and the two free edges 55 and 56 of the assembled sheets are brought together, overlapped and welded together, as at 23 in FIGS. 1 and 2, the weld 23 extending from one end of the bag to the other. Thus there is a single longitudinal join to form the bag into a generally tube shape.

After assembly in this manner one end of the length of joined outer and inner sheets 10 and 11 is closed by a transverse seal 24 at an extreme end of the bag and extending transversely of the length of the bag. This joins together the inner surfaces of the outer length 10 and seals the end 12. In addition diagonal seals or welds 25 join the length 10 together from a position centrally of the end 12 of the bag and extending diagonally outwards to positions adjacent one end of the inner portion 11 of the bag, as shown particularly in FIG. 1. The provision of these seals or welds 25 ensures that there are no corners or folds in the base of the bag in which product can collect.

As shown in FIG. 1 the bag is open at the end 13 and remains open whilst product is filled into the bag. After filling the end 13 is closed and sealed by a similar weld to weld 24, but not shown. This operation is usually performed remote from the bag making facility and where filling takes place. If required a discharge arrangement may be built into the bag and this may take the form of a spout member 27 which is secured, for example by welding to the inside surface of the outer portion 10, access to the spout portion being obtained by removing a portion 28 of the sheet material from the inner part of the spout to give access to the spout 27. Until such portion is removed the bag remains sealed and secure against leakage. The spout 27 may include a flexible part which may project through the opening 28 formed in the material 10.

Figure 3:
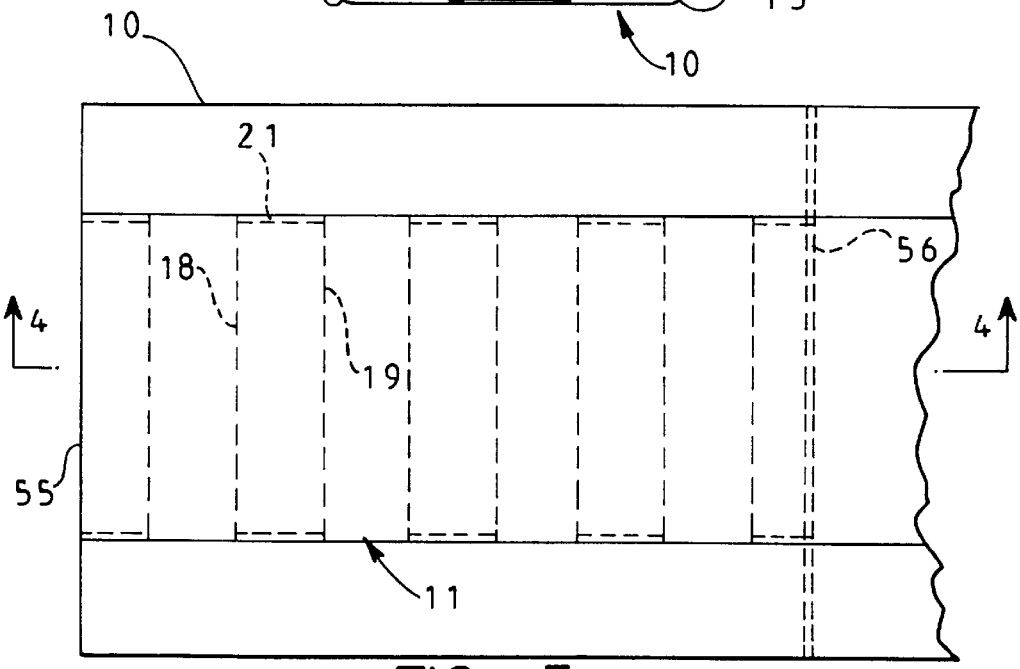
FIG. 3 shows a plan view of a bag at an intermediate stage of its formation.
Figure 4:
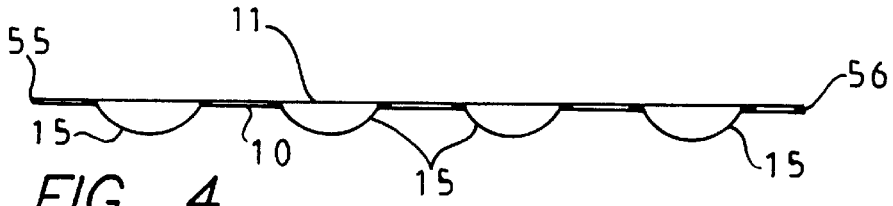
FIG. 4 shows a cross-section along the line 4—4 in FIG. 3.
Figure 5:
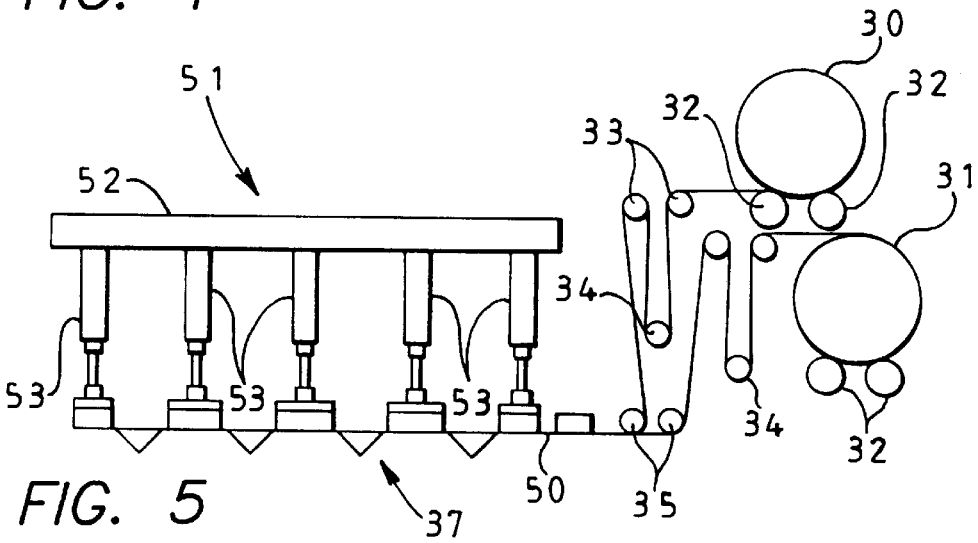
FIG. 5 shows a side elevation of apparatus for making the bag.
Figure 6:
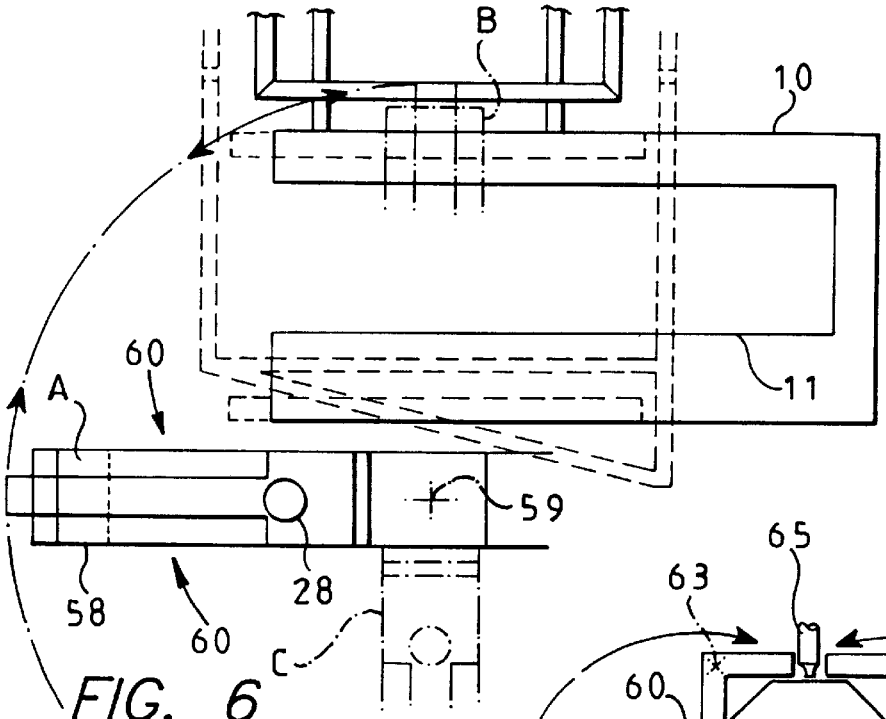
FIG. 6 shows a plan view of the apparatus.

Referring now to FIGS. 3–10 there is shown, diagrammatically, apparatus by which the previously described bag may be formed. In FIG. 5 is shown two reels 30 and 31. The reel 31 carries plastic sheet material to form the outer part 10 of the bag and the reel 30 carries plastic sheet material to form the inner part 11 of the bag, the sheet material on the reel 30 being of a lesser width than the material on the reel 31 and the reel 30 being located centrally with respect to the reel 31. The reels 30 and 31 are supported on rollers 32 which are driven to rotate the reels and unwind sheet material from the reels 30, 31.

In passing from the reels 30, 31 the sheet material passes over a series of accumulator rollers 33 in each case and a vertical gravity roller 34 by which a constant tension is maintained in the sheet material. The material then passes around rollers 35 to extend in a horizontal direction from the rollers 35 and onto a table 37, sheet from the reel 30 being located over sheet from the reel 31.

The table 37 (see FIGS. 8, 9 and 10) is formed of a series of interconnected portions of which portions 40, 40A and 41 provide support surfaces fixed in the vertical direction but moveable in a horizontal plane. Portions 41 are at the input and output end of the table and portion 40A is a centre portion.

Between the portions 40, 40A and 41 of the table are connected articulated plates 42 and 43 pivotally connected to the members 40 and 41 about pivots 44 and pivotally connected to each other about pivots 45.

The outer and inner sheets 10 and 11 are laid on the table 37 (see Fig.8) so that sheet 10 lies under sheet 11 and the sheets 10 and 11 lie in the horizontal plane. In order to form the corners or pockets 15 in the finished bag the outer sheet 10 needs to be drawn down out of the plane of the table and this is achieved by the table portions 40, 40A and 41 closing up on one another so that the plates 42 and 43 pivot about pivots 44 and 45 to take up an intermediate position shown in FIG. 9 inclined to the horizontal, moving towards a final position shown in FIG. 10. A vacuum may be provided through one or both of plates 42 and 43 to draw the material 10 down into the openings formed in the table and in contact with the upper surfaces of the plates 42 and 43. This shapes the material 10 to provide the corner portions 15 and the lengths 10 and 11 are ready to be joined together by welding. Alternatively the material 10 is drawn down mechanically into the openings.

The plates 42 and/or 43 may be perforated to permit a vacuum generated under the plates to draw the material against the upper surfaces of the plates 42 and 43. Conveniently vacuum chambers (not shown) are located beneath plates 42 and 43 in which vacuum is generated to effect this action.

Figure 8:
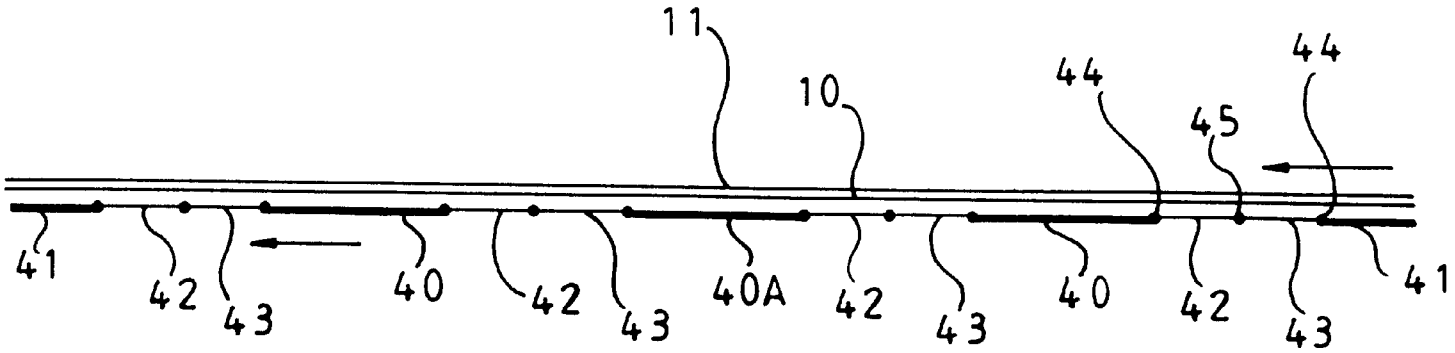
FIG. 8 shows in cross section a diagrammatic view of one stage in the bag making procedure.
Figure 9:
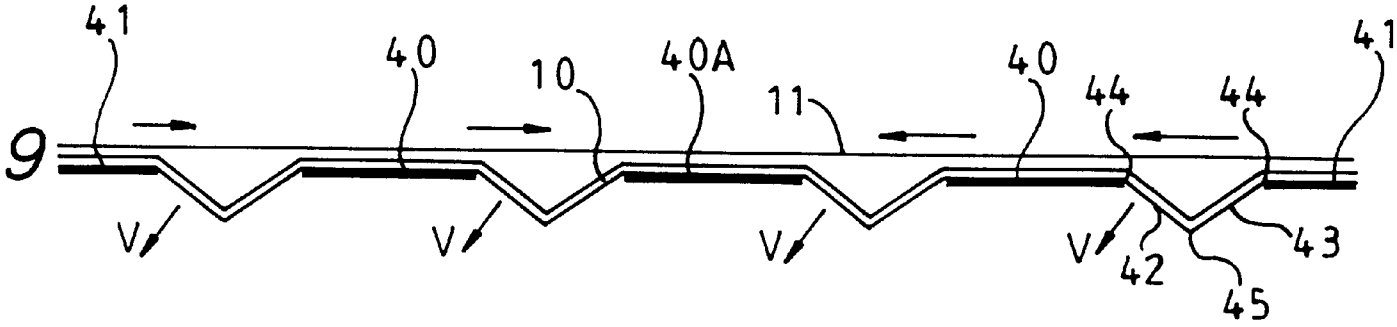
FIG. 9 shows a similar view to that of FIG. 8 at an intermediate stage of the procedure.
Figure 10:
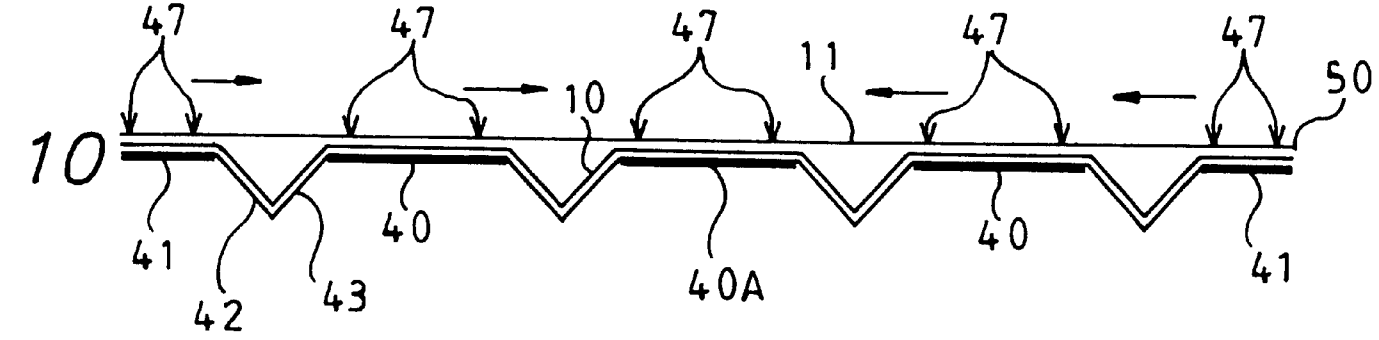
FIG. 10 shows a similar view to FIGS. 8 and 9 at a third stage of the bag making procedure.

Relative movement between the table parts 40, 40A and 41 may be achieved in any convenient manner whereby the table parts 40 and 41 are moved together simultaneously, maintaining the central table part 40A in a fixed central position and moving the parts 40 and 41 to each side of the central part 40A towards the central part 40A, as shown in FIGS. 8–10.

After completing a drawing down of the material 10 into the pockets formed by the plates 42 and 43, achieving the position shown in FIG. 10, the sheets 10 and 11 may be welded together at the weld positions shown at 47 in FIG. 10. It will be seen that the weld positions 47 are located adjacent the pockets formed in the material 10 and extending across the full width of the sheet 11. The welds 47 are the welds described in relation to FIGS. 1 and 2 as welds 18 and 19. At the same time a transverse weld 21 is formed between the sheets 10 and 11 towards the outer edge of the sheet 11.

After completion of this stage of the bag formation process the incoming lengths of material may be severed at the position 50 where there may also be a clamp clamping the sheets together, severing taking place in the transverse direction to give the required finished length of joined material 10 and 11.

The welding process may be provided by the welding apparatus 51 shown in FIG. 5, this apparatus 51 comprising a pivoted beam 52 extending longitudinally of the lengths of material and carrying five welding arms 53 extending downwardly from the cross beam. The welding arms 53 have at their lower ends welding means for achieving the welds 47 extending transversely of the length of material and welds 20 extending in the longitudinal direction. The welding arms 53 are vertically moveable in and out of engagement with the length of material and during welding the surfaces of members 40 and 41 provide an abutment for the welding action.

On completion of welding of the sheets 10 and 11 the joined sheets may take the form shown in FIG. 4, the portions 15 in FIG. 4 being the portions to form the corners of the completed bag. FIG. 3 shows in plan the sheets of material 10, 11 in position on the table 37 after the welding operation has been performed.

It is now required to bring the free ends of 55 and 56 of the joined lengths 10 and 11 together, overlap the ends and weld the overlapped ends to provide the join 23. This is best achieved by the joined lengths 10 and 11 remaining in position on the table 37 but can be done at another joining station.

Figure 7:
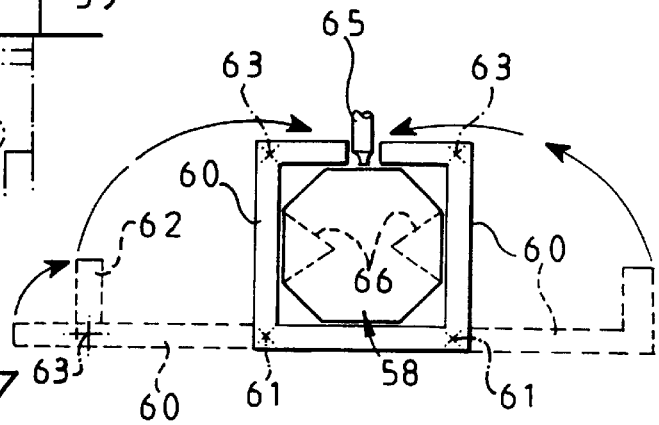
FIG. 7 shows a side elevation of part of the bag making apparatus.

For joining the free ends 55 and 56 a former 58 is provided pivotable about a vertical pivot 59 (FIG. 6) from a position A in a clockwise, as shown, direction through 90° to a position B extending transversally across the joined lengths 10 and 11. Alternatively a former 58 is provided about a vertical pivot 59 (FIG. 6) from a position C (FIG. 6) in a direction through 180° to position 'B'. The former 58 is of generally octagonal shape conforming to the intended shape of the inner length 11, as seen in FIG. 7. The former 58 has pivotable arms 60 at each end, which each pivot about a pivot 61 and which are moveable between a position shown in chain lines in FIG. 7 towards the position shown in full lines. The outer ends 62 of the arms 60 are each pivotable about a pivot 63 from an aligned position with the rest of the arm to a position at right angles thereto.

When the octaganol part of the former 58 has been located over the lengths 10 and 11 the arms 60 are pivoted from the chain line position towards the full line position moving with them the ends of the lengths onto the top part of the former 58 so that they overlap, there being a small gap between the outer ends of the arm parts 62. The overlapped parts of the length are then welded together by a welding device 65 which uses the former as an abutment and locates the said space.

The arms are then moved back to their start position, the lengths 10 and 11 having been formed into a tube welded along a single weld line 23. In order to release the tube from the former 58 the vertical sides of the former may be collapsed so that the height of the former is reduced, for example by the former sides 66 articulating to the position shown in chain lines in FIG. 7. This action causes the lengths 10 and 11 to move inwards at their sides to fold in the sides and the tubular lengths 10 and 11 can be removed from the former with the former having been pivoted to the full line position shown in FIG. 6.

It will be appreciated that the arms 60 are in pairs, a pair disposed at each of the sides of the assembled lengths 10 and 11, and the outer ends of the arm portions 62 carry means for gripping the edges of the lengths towards the outer ends thereof so that, as the arms 62 pivot upwards about the pivot 63 and then about the pivot 61, the ends of the lengths are carried over the former 58 to the overlapped position of the lengths 10 and 11.

The transverse seal 24 at one end of the tube can then be made at a separate welding station on which the folded up tube is laid and a weld is formed at the end 12 to close one end of the tube to form the bag. It will be seen from FIG. 6 that the former 58 can also be pivoted through a further 90° as shown at C in case the bag released from the former 58 needs to be passed in this direction.

At the same time as making the transverse base seal 24 the diagonal seals 25 can be made in the base of the bag.

After completion of the seals 24 and 25 the bag is complete and ready for filling. At this stage the bag is folded flat on itself but it is a simple matter to open the bag up at its open end to fit under a filling device for filling product into the bag. As explained the filled bag can then be sealed by a transverse seal across the end 13 of the bag.

As an alternative to the manner of operation of the table 37, as shown in FIGS. 8–10 the table may be operated differently. For example when the lengths 10 and 11 are placed on the table the portions 40 and 41 may be located closely adjacent one another with the plates 42 and 43 directed substantially vertically downwards, the upper surfaces of the portions 40 and 41 providing a support surface for the lengths. In order to form the length 10 into the desired pockets the support portions 40 and 41 towards the left hand end of the table, as seen in FIGS. 8–9 are separated thereby forming an opening into which the length 10 may be drawn by applying a vacuum to the plate 42 and/or 43. The gap between the portions 40 and 41 may then be closed. Alternatively the gap may remain open. Next and in sequence the portions 40 and 40A are moved apart to admit the length through the opening under the action of the vacuum on the plate 42 and/or 43, this sequence continuing between the portions 40A and 40 and 40 and 41 to form the other corner portions 15 against the plates 40 and 43. On completion of this sequence there is provided the arrangement shown in FIG. 5 whereby the welds 47 can be made to join the lengths 10 and 11 together.

The apparatus for forming the bags is of relatively simple construction and can form a succession of bags of the selected dimensions in an accurate manner.

The joining together of the lengths 10 and 11 and forming of the weld 23 and 24 can be improved and made more secure by using plastics material, at least for the outer length 10, which is of the kind having a laminated or coaxial construction. In this construction an outer layer of plastic is formed with a lower melting point than the remainder of the plastic sheet. When the sheet is to be welded to itself welding apparatus can be used which is heated to the lower melting point temperature and so cannot melt the other higher melting point plastic. Thus when the two lower melting point surfaces are brought together and heated to said lower temperature a satisfactory weld seal is made which does not have the likelihood of a defective weld which would affect the integrity of an assembled bag. Such plastics are generally available from manufacturers such as Dow, Dupont and Exxon.

We claim:

1. A method of forming a bag from flexible plastics sheet material wherein two lengths of flexible plastics sheet are laid one over the other, one of the lengths being to define an outer portion of the bag, the other length providing an inner portion of the bag, said outer length is shaped to provide a succession of four pocket portions extending transverse to its length, said pocket portions extending out of the plane of said length, said shaping involving laying said outer length on a surface having four spaced apart openings corresponding to the number of pockets to be formed, laying the inner length over the outer length, moving the outer length in a longitudinal direction of the sheet length to enter said openings to form said pocket portions simultaneously, with the inner length remaining in the plane of said surface, securing together the inner and outer lengths between said pocket portions, forming the ends of the two lengths and bringing the ends together to form overlapped ends, securing the overlapped ends together to form a tube and securing one end of the tube to form a closed end tube, the other end comprising a filling opening for the bag.

2. A method according to claim 1 wherein the closed end of the bag is formed by welding the outer lengths together in a direction transverse to the longitudinal direction of the bag.

3. A method according to claim 2 wherein the closed end of the bag is also formed with connections defined by diagonal joints extending between a central position at the end of the bag and a position displaced along the bag from said end.

4. A method according to claim 1 wherein the lengths of sheet material are joined by welding achieved by directly or indirectly heating the lengths of material to connect them together.

5. A method according to claim 1 wherein, after said pocket portions have been formed the inner and outer lengths of plastics material are welded together at predetermined positions longitudinally spaced along said lengths and between said pocket portions using said surface as an abutment.

6. A method according to claim 1 wherein, after the inner and outer lengths are connected together, the lengths are severed at one end in a transverse direction to the lengths, the free ends of the lengths are brought together. overlapped and connected together, and the free ends of the lengths are joined by locating a former over the lengths, moving the ends of the lengths over the former until they are overlapped, then welding the ends together using the former as an abutment.

7. A method according to claim 6 wherein the former is arranged so that the inner length of material takes up a generally octagonal shape.

8. Apparatus for making bags of plastics sheet material comprising a table surface over which two lengths of flexible sheet may be laid, one over the other, openings at spaced locations along the table surface into which openings the lower length of material may be drawn to define pocket portions extending out of the plane of said length at spaced locations along the table, welding means positioned over the table adapted to weld together the lengths of material together between said pocket portions, forming means adapted to bring together the ends of the connected lengths to overlap said ends, welding means for welding the ends together to form a tube, and welding means for forming a base closure at one end of the bag.

9. Apparatus according to claim 8 comprising a former locatable over the table and about which the interconnected lengths of material are drawn so that the ends are brought together, overlapped and secured together to provide a closed length or tube of sheet material.

10. Apparatus according to claim 9 wherein the former is movable to release the closed length of sheet material whereby the material can be folded up to a flat condition for sealing one end of the bag to form a closed end.

11. A method according to claim 1 including the step of forming the outer length of material into a succession of pocket portions by the step of drawing said length out of said plane by vacuum means or by the step of drawing said portions out of said plane.

12. A method according to claim 1 wherein, subsequent to a step of connecting the inner and outer lengths together, further including the step of severing said lengths at one end in a transverse direction to the lengths, and bringing the free ends of the lengths together, overlapping and connecting the same together.

13. A method of forming a bag from flexible plastics sheet material wherein two lengths of flexible plastics sheet are laid one over the other, one of the lengths being to define the outer portion of the bag, the other length providing the inner portion of the bag, said outer length is shaped to provide a succession of pocket portions extending transverse to its length, said pocket portions extending out of the plane of said lengths, said shaping moving the outer length in a longitudinal direction of the sheet length to form said pocket portions, securing together the inner and outer lengths between said pocket portions, forming the ends of the two lengths, and bringing the ends together to form a closed formation securing the ends together to form a tube, and securing one end of the tube to form a closed end tube, the other end comprising a filling opening for the bag, wherein the free ends of the lengths are joined by locating a former over the lengths, moving the ends of the lengths over the former until they are overlapped and the shape of the inner length of material is generally octagonal, then welding the ends together using the former as an abutment.

14. Apparatus according to claim 8 wherein the table comprises relatively moveable transverse portions between which said openings are defined, said portions being moveable apart to enable the lower length of material to be drawn into said openings and said sections being moveable towards one another to close up said openings.

* * * * *